United States Patent [19]

Garvey

[11] 4,362,175

[45] Dec. 7, 1982

[54] DANDRUFF REMOVER COMBS

[76] Inventor: James P. Garvey, 11 Andersonstown Rd., Belfast, Northern Ireland, BT11 9AF

[21] Appl. No.: 144,508

[22] Filed: Apr. 28, 1980

Related U.S. Application Data

[63] Continuation of Ser. No. 828,975, Oct. 28, 1977, abandoned.

[30] Foreign Application Priority Data

Aug. 31, 1977 [GB] United Kingdom ..... 36425

[51] Int. Cl.[3] ..... A45D 24/42

[52] U.S. Cl. ..... 132/119; 30/30; 30/320; 132/160

[58] Field of Search ..... 132/124, 126–128, 132/139, 144, 160; 30/30, 320

[56] References Cited

U.S. PATENT DOCUMENTS

| | | | |
|---|---|---|---|
| 1,224,462 | 5/1917 | Harris | 30/30 |
| 1,235,404 | 7/1917 | Wehrsen | 132/124 X |
| 1,359,343 | 11/1920 | Dodge | 132/124 |
| 1,476,672 | 12/1923 | Sellers | 30/320 X |
| 1,795,957 | 3/1931 | McCloskey | 132/124 |
| 3,803,712 | 4/1974 | Spanel | 30/30 |

FOREIGN PATENT DOCUMENTS

| | | | |
|---|---|---|---|
| 601057 | 12/1959 | Italy | 30/30 |

*Primary Examiner*—G. E. McNeill

*Attorney, Agent, or Firm*—Sprung, Horn, Kramer & Woods

[57] ABSTRACT

A dandruff remover device including two inclined combs connected to a holder for a blade having a non-cutting edge, which blade is arranged to be extended to against spring pressure into a cleaning position between the teeth of the combs.

9 Claims, 12 Drawing Figures

DANDRUFF REMOVER COMBS

This is a continuation of application Ser. No. 828,975 now abandoned, filed Oct. 28, 1977.

This invention concerns the use of the Dandruff Remover Combs which is an improvement on the present method of washing. Dandruff is in which small flakes of dead skin form in the hair and it is caused by a disorder of the glands in the scalp that secrete sebum oil. There may be too little oil, giving rise to dry, brittle hair and white flakes of skin, or more often too much, giving greasy hair and yellow scales of dandruff.

The usual treatment is to wash the hair several times a week while the condition persists, using a detergent shampoo if the hair is oily.

With my invention of removing dandruff from a person's head, I have used two combs in a angular position with a non cutting blade between the two combs.

The combs are of rigid material, and their weight and hardness has the usefullness of loosening and dislodging the loose parts of dried skin that may be adhering to the scalp of the user.

The assembly is used in the ordinary way of combing one's hair, with the non cutting edge of the blade intercepting the hair as it passes through the combs, the hair with particles of dandruff adhering to it will come in contact with the non cutting edge of the blade and the dandruff is literary skimmed off the hair.

By repeating this effort and increasing the pressure on the hair by the blade, one could presume that all the particles of dandruff would be removed.

The assembly fits nicely into the palm of the user, and there is no need to ever replace the blade, neither is there any danger in using.

I believe this is a vast improvement on the present method of washing one's hair, and rubbing with fingers in the process of dislodging the scales of dandruff, and the subsequent delay in drying one's hair, whereas my invention can do it in a matter of minutes, with no discomfort and the result observed and calculated if necessary.

Figure 1:
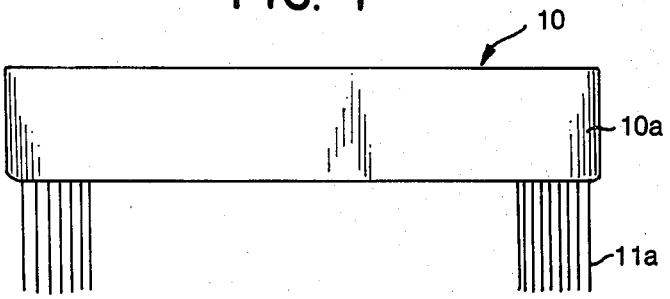
Figure 2:
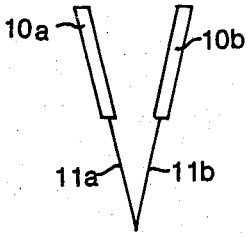

The following is a description of the dandruff remover combs including the assembly in accordance with the invention, given by way of example, and taken in conjunction with the accompanying drawings, in which:

FIG. 1 The comb 10 is of rigid material, for example chromium plated steel, and has a row of closely spaced parallel teeth 11*a*, 11*b* each of circular cross section, and less than 1/16th of an inch apart, the teeth extending outwardly from a rib 10*a*, 10*b* of width to afford a size sufficient to hold together a second simular comb, FIG. 2 Shows the angle of the two combs, as in a V shape, at the angle of 15 degree, prior to be fastened together.

Figure 3:
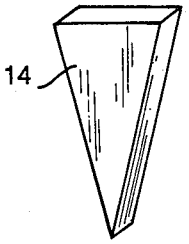

FIG. 3 Shows one of two end covers 14, which are of rigid material for instance steel, and screwed from the combs to hold firmly the two combs in their angular position.

Figure 4:
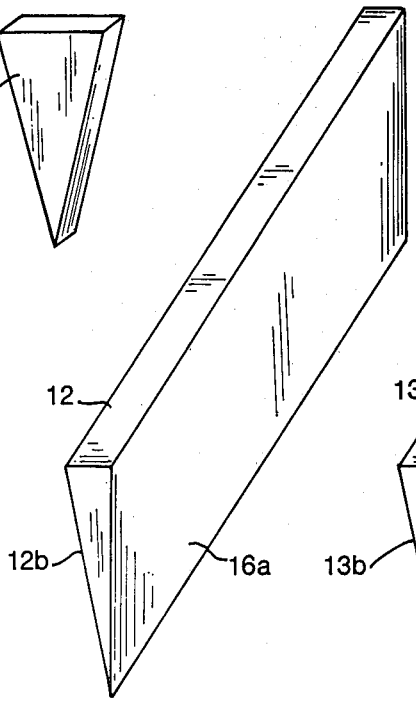

FIG. 4 Shows one section of guide 12 for blade holder, which is of rigid material, one side 12*a* is perpendicular, with the other 12*b* angled to fit the angle of the comb and is fastened to the interior of the comb.

Figure 5:
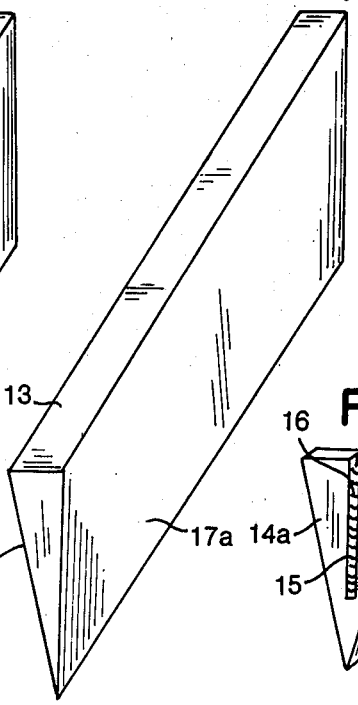

FIG. 5 Is compliment 13, 13*a*, 13*b* to FIG. 4 and is fastened in the same method thus forming an entrance for the blade holder.

Figure 11:
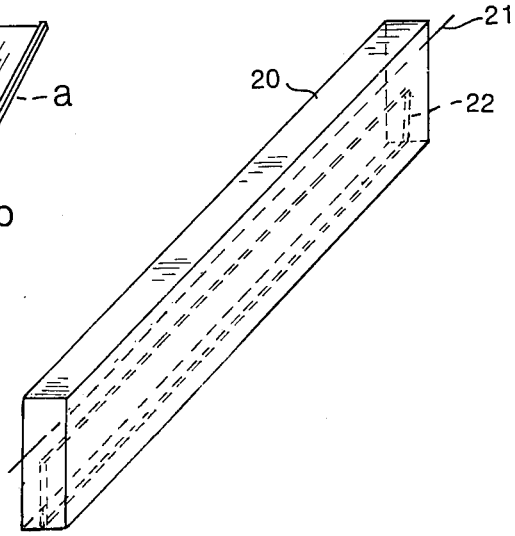

FIG. 11 Shows the blade holder 20 with a projecting metal rod 21 at either end which is enclosed in the length of the blade holder. At the base, there is a slot 22 to hold a blade.

Figure 10:
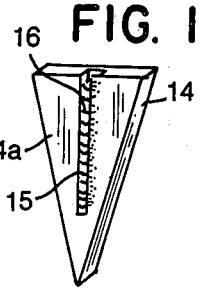

FIG. 10 Shows as B the interior side 14*a* of one of the two covers 14 together with an enclosed spring 16, which is countersunk inside the cover and flush with it as shown.

The enclosure of each spring has one drift cut down 15 for each projecting arm 21 to pass and rest on top of the spring, this allows the blade holder to move freely up and down. The length of the spring has been calculated that the blade holder with the blade is contained within the two combs, as a safety measure.

Figure 7:
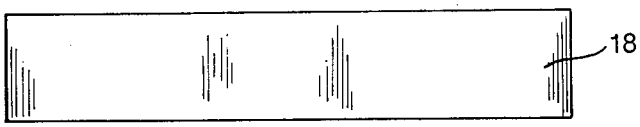

FIG. 7 Shows the blade 18 which is of steel, and has no cutting edge, and is shorter in length than the combs, which provides a long blade to come in contact with the hair.

The blade is inserted in the slot 22 FIG. 11 which is slightly bevelled, the tension of the bevel on the blade holds it firmly in position.

Figure 12:
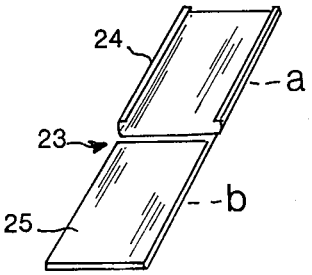

FIG. 12 Shows a cover 23 for the spring 16 of FIG. 10 and it also impinges on the blade holder FIG. 11 to keep it in the chamber and to return to being in a handy position.

Part 24 is fastened to the top edges of members 12, 14 and part 25 covers the spring inlet of covers 14, and presses on the blade holder 20.

Figure 6:
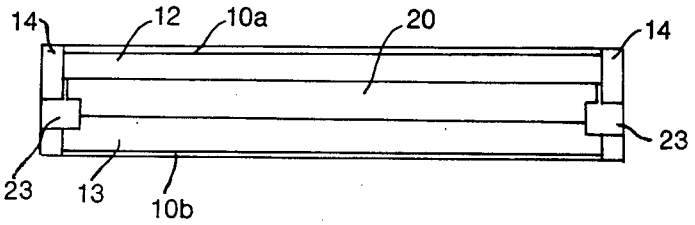

FIG. 6 Shows the plan of the top of the assembly including members 12, 13 as the side parts of the blade guide and members 14 as the end covers.

The covers 23 are attached to top edges of member 12, 14 over the spring inlet and giving resistence to the blade holder 20.

Figure 8:
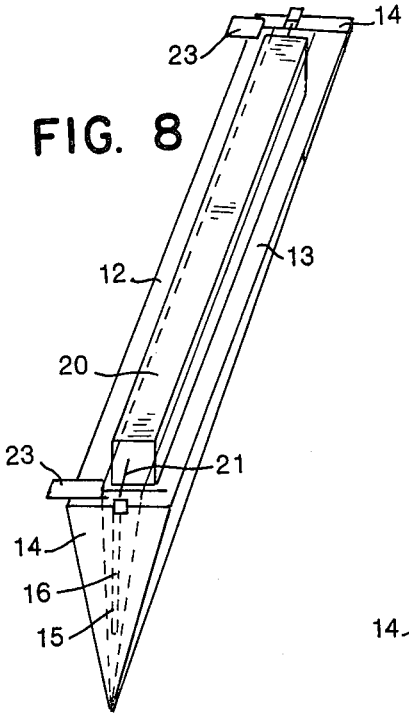

FIG. 8 Shows the blade holder 20 entering the combs between the guides 12, 13, with the covers 23 pulled out to allow the projecting rods 21 to be on the top of the springs 16.

Figure 9:
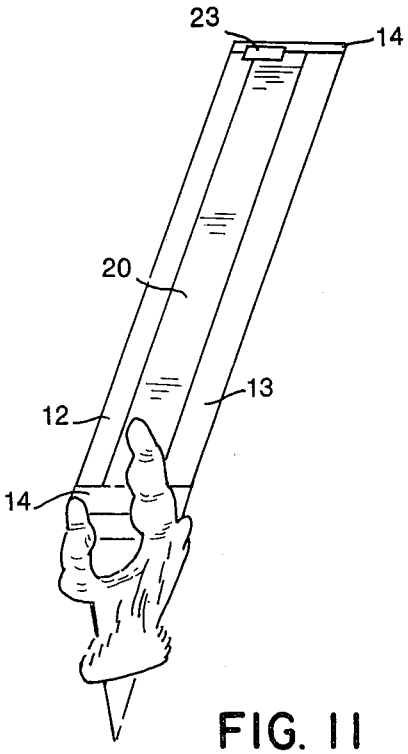

FIG. 9 Shows the pressure being applied by the first finger to the top of the blade holder to push forward the blade into the apex of the combs, and for the blade to come in contact with the shorter hairs as would be at the neck.

A is shown as FIG. 12 covering the spring inlet, and keeping the blade holder in the assembly.

What I claim is:

1. A dandruff remover device including two inclined combs connected to a holder for a blade having a non-cutting edge, which blade is arranged to be extended against spring pressure into a cleaning position between the teeth of the combs.

2. The dandruff remover combs as claimed in claim 1 wherein the combs comprising of a frame from which the teeth emerge and each at an angle of 15 degree from the points of being close to each other.

3. The dandruff remover combs as claimed in claim 1 wherein the bladeholder is contained in the assembly and to arrive in the centre of the two combs.

4. The dandruff remover combs as claimed in claim 1 wherein the manual operation is provided by pressing a finger on the top of the bladeholder and pressing down to its total depth.

5. The dandruff remover combs as claimed in claim 2 wherein the comb has distances between each tooth of one-thirtysecond of an inch.

6. The dandruff remover combs as claimed in claim 2 wherein the frame thus attached is greater by twice the area of the total teeth area.

7. The dandruff remover combs as claimed in claim 5 wherein the blade is attached to the bladeholder through a slot to a distance of from six-sixteenths of an inch to ten-sixteenths of an inch and being under pressure and projecting outwardly for a distance of from one-quarter of an inch to one inch.

8. The dandruff remover combs as claimed in claim 4 wherein the bladeholder is assisted to move and retract by the use of a spring attached on each side and is contained in the assembly.

9. The dandruff remover combs as claimed in claim 8 wherein the bladeholder ascends to the top position and is contained therein by a moveable plate.

* * * * *